US009284771B1

(12) United States Patent
Doherty

(10) Patent No.: US 9,284,771 B1
(45) Date of Patent: Mar. 15, 2016

(54) OVERHEAD DOOR EQUIPMENT TROLLEY

(71) Applicant: Victor J. Doherty, Wellesley, MA (US)

(72) Inventor: Victor J. Doherty, Wellesley, MA (US)

( * ) Notice: Subject to any disclaimer, the term of this patent is extended or adjusted under 35 U.S.C. 154(b) by 3 days.

(21) Appl. No.: 13/858,077

(22) Filed: Apr. 7, 2013

Related U.S. Application Data

(60) Provisional application No. 61/622,664, filed on Apr. 11, 2012.

(51) Int. Cl.

| | |
|---|---|
| ***E06B 7/00*** | (2006.01) |
| *E05F 15/668* | (2015.01) |
| *E05F 15/684* | (2015.01) |
| *E05D 15/06* | (2006.01) |
| *E05D 15/26* | (2006.01) |

(52) U.S. Cl.
CPC ..... *E06B 7/00* (2013.01); *E05D 15/063* (2013.01); *E05D 15/26* (2013.01); *E05F 15/668* (2015.01); *E05F 15/684* (2015.01); *Y10T 16/35* (2015.01); *Y10T 16/364* (2015.01)

(58) Field of Classification Search
CPC . E05D 15/26; E05D 15/063; E05Y 2900/106; E05Y 2201/21; E05Y 2201/64; E05Y 2201/684; E05Y 2600/60; E05Y 2800/244; E05F 15/668; E05F 15/684; Y10T 16/35; Y10T 16/364; Y10T 16/381
See application file for complete search history.

(56) References Cited

U.S. PATENT DOCUMENTS

| | | | | |
|---|---|---|---|---|
| 6,325,134 | B1 * | 12/2001 | Mullet | 160/189 |
| 2003/0001752 | A1 * | 1/2003 | Teves | 340/693.9 |
| 2004/0016080 | A1 * | 1/2004 | De Oliveira | 16/97 |
| 2008/0047672 | A1 * | 2/2008 | Gorman et al. | 160/1 |

* cited by examiner

*Primary Examiner* — Brodie Follman
*Assistant Examiner* — Hilary L Johns
(74) *Attorney, Agent, or Firm* — Lathrop & Gage LLP

(57) ABSTRACT

A trolley for supporting equipment on an overhead door using the existing track for the overhead door is described. The invention may be used to allow utility items such as lighting, electrical outlets, and safety devices to be mounted conveniently and efficiently.

13 Claims, 7 Drawing Sheets

OVERHEAD DOOR EQUIPMENT TROLLEY

PRIORITY

This application claims the benefit of the priority of U.S. provisional application 61/622,664, which is incorporated herein by reference.

BACKGROUND

The present invention generally relates to the field of electro-mechanical equipment and more particularly to means for supporting said equipment for use in residential and/or commercial garages or work bays with overhead doors. Typically in such spaces electrical power is not readily available except around the perimeter of the space, yet much of the work that takes place in these locations is not near the perimeter. For example, automotive repair work is performed on the vehicle wherever it is parked in the garage bay. Similarly, lighting is often poor in garages that were designed primarily for automobile storage.

In some commercial garages or work bays, special accommodations have been designed into the structure to provide electrical and other utilities away from the perimeter of the space. Electrical power, for example, may be available using a ceiling mounted, retractable extension cord device, the extension cord being electrified from junction boxes distributed where needed on the ceiling. Similarly, by advanced planning, some commercial garages have ceiling mounted light fixtures distributed above the expected work spaces.

In other commercial garages, these amenities may not be available, particularly if the garage was not originally designed to serve as a work space. Similarly, nearly all residential garages lack these amenities, again because they were not originally designed to be work spaces.

An additional obstacle in providing electrical or mechanical amenities in a garage or work bay is the most common vehicle access door in these spaces—the overhead, roll-up door. By definition, an overhead roll-up door will, when in the open position, intercept the space between the ceiling and the work space below. Thus, no permanent, ceiling mounted device can be installed above the work space unless the device can fit entirely above the raised roll-up door.

Furthermore, in retrofit applications, permanent ceiling mounted devices often require expensive renovation work or, at a minimum, the service of licensed tradespeople.

There is, therefore, a need for an easily installed means of providing electrical or mechanical utilities in existing work spaces.

SUMMARY OF THE INVENTION

The present invention comprises an apparatus for providing electrical utilities to support lighting and electrically powered equipment in pre-existing workspaces, the workspace having an overhead roll-up door. That is, workspaces like residential garages having roll-up, overhead doors rather than swing open doors for, typically, vehicular access.

In one instance the apparatus is a trolley, the trolley being a platform to support or carry items and/or to carry electrical utilities from the location of a fixed outlet to a designated location where the electricity is needed. The trolley generally has four wheels or rollers, wherein rollers are a common term for wheels designed to ride in overhead garage door tracks. The four rollers are generally located near the corners of the trolley. In one instance, the rollers are designed to ride in the tracks of a pre-existing, roll-up door such as is used for vehicular access to a garage. In some embodiments the trolley may have only one roller on each of two parallel sides.

In another instance the trolley comprises skid blocks to replace the rollers, the skid blocks being designed to ride in the same existing overhead roll-up door tracks.

In one instance the trolley is approximately the width of the garage door, and has two rollers in the door's left hand track and two rollers in the door's right hand track.

In another instance, the trolley is disposed between two roll-up overhead doors of a double door garage. In this instance the trolley has its two left hand rollers in the right hand track of one door and its two right hand rollers in the left hand track of the adjacent door.

In some embodiments the trolley comprises a flat platform while in other embodiments the trolley additionally comprises one or more sidewalls, forming a tray- or pan-like structure. In other embodiments the trolley further comprises an enclosing plate that completes a box structure.

In some embodiments the trolley comprises only sidewalls, with no platform, in which embodiments the electrical utilities are transported by the sidewalls.

In some instances the trolley comprises an electrical power cord. One end of the power cord is equipped with an approved electrical plug compatible with local electrical codes. The other end of the cord may terminate in a so-called power strip, which typically provides a number of standard electrical outlets compatible with local electrical codes. In other instances this second end of the electrical power cord may be "hard-wired" to one or more pieces of electrical equipment.

In some instances the trolley comprises one or more electric light fixtures.

The above and other features of the invention, including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE FIGURES

The foregoing and other objects, features and advantages of the invention will become apparent from the following description in conjunction with the accompanying drawings, in which reference characters refer to the same parts throughout the different views. The drawings are not necessarily to scale; emphasis has instead been placed upon illustrating the principles of the invention. In the drawings.

DETAILED DESCRIPTION OF THE INVENTION

Figure 1:
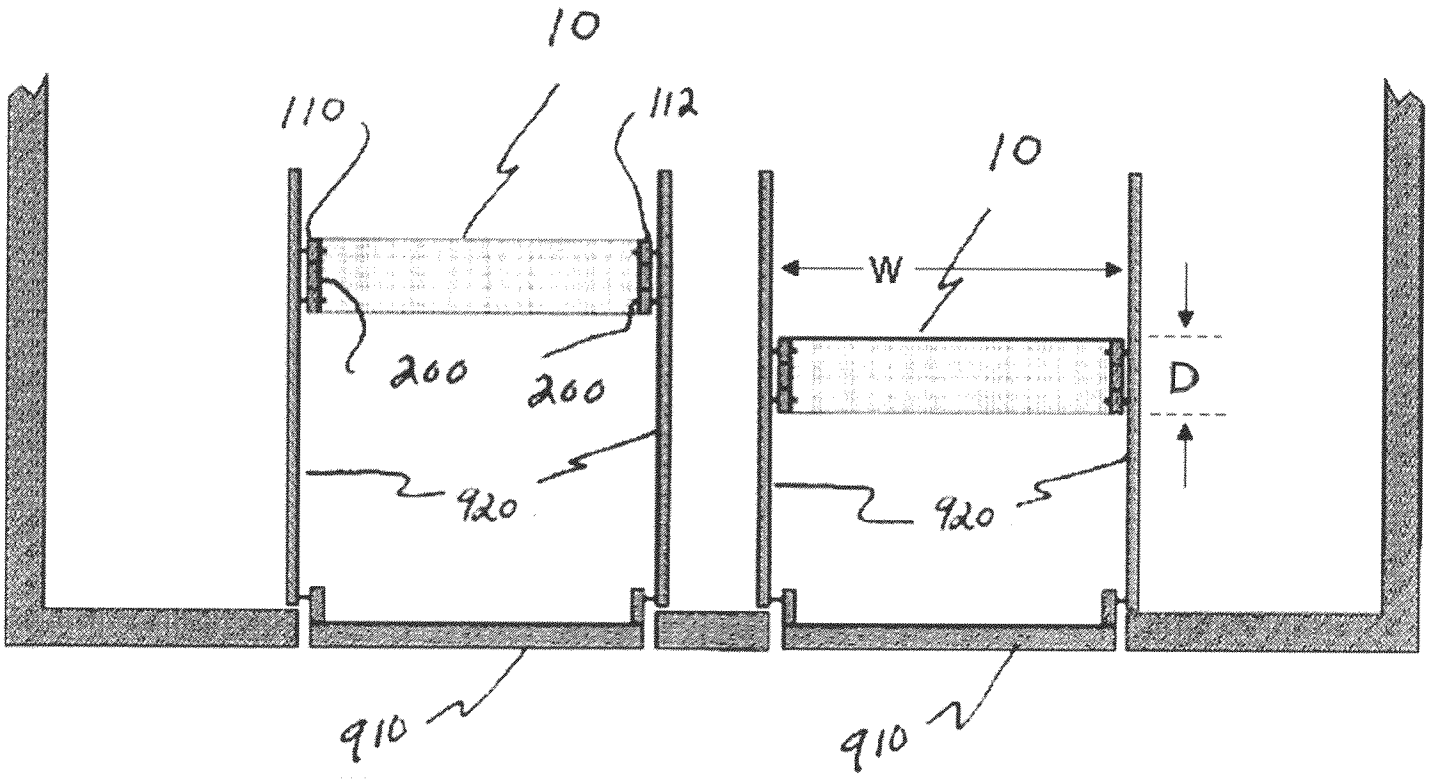
FIG. 1 illustrates schematically an exemplary installation of a trolley.

FIG. 1 illustrates a top view of an embodiment of an overhead door equipment trolley 10 as it would be typically installed in a workspace having two roll-up, overhead doors 910. Two individual trolleys 10 are shown in this exemplary installation, one for each of the two workspaces. In this embodiment, trolley 10 comprises a support platform 100 to which various pieces of electrical or non-electrical equipment may be attached. Each trolley 10 further comprises two roller sets 200, one attached to a left side 110 of support platform 100 and one attached to a right side 112 of support platform 100, where left and right are arbitrarily defined as viewed from the access door. Trolley 10 is designed to be supported by two existing tracks 920 provided for the roll-up overhead door.

The three-dimensional outline of trolley 10 typically comprises a generally low rectangular shape comprising a height, a width, and a depth. When trolley 10 is intended to be installed in a garage or other workspace that has an roll-up overhead access door 910, the width, "W", of trolley 10 is the lengthwise dimension of the two sides of the rectangle parallel to access door 910, the depth, "D", of trolley 10 is the lengthwise dimension of the two sides parallel to the tracks 920 on which the roll-up overhead door rolls up, and the height of trolley 10 is the remaining (vertical) dimension. For clarity, the depth sides of trolley 10 are the left side 110 and right side 112 and the width sides of trolley 10 are what would conventionally be called the front and back sides, the front being closest to the access door. Typically, the width of trolley 10 is greater than its depth and the height is significantly less than either of the other two dimensions.

Figure 2:
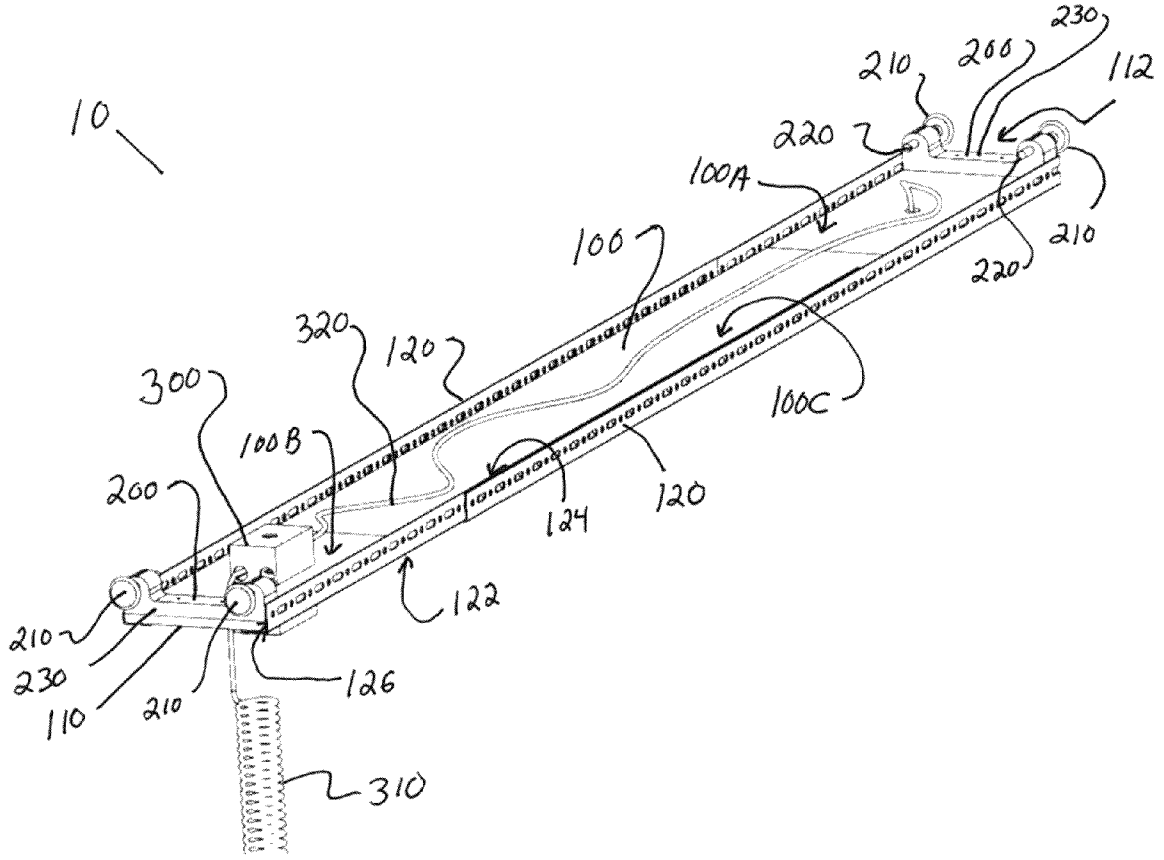
FIG. 2 is an illustration of an embodiment of an overhead door equipment trolley.

Typically, as shown in FIG. 2, trolley 10 also comprises one or more side walls 120, in which embodiment trolley 10 has a tray- or pan-like structure, and often further comprises an enclosing plate (not illustrated), in which embodiment trolley 10 is box-like. Note that side walls 120 may extend upwardly or downwardly from support platform 100. Generally, side walls 120 are attached to support platform 100 along one edge 122 and the enclosing plate, if used, is attached to one or more side wall 120, that attachment being along an edge 124 running parallel to edge 122. In one embodiment, side walls 120 extend upwardly from support plate 100, so the enclosing plate is a top. In that embodiment (not illustrated), trolley 10 is box-like, which makes cleaning easier.

In other embodiments, trolley 10 does not include support platform 100 and instead, comprises the side walls 120, each joined to the adjacent sidewalls along their respective edges 126, edges 126 being generally perpendicular to edges 122 and 124. In yet other embodiments, trolley 10 comprises one or more sections of support platform 100, wherein the sections do not extend over the full length of trolley 10.

The attachments between support platform 100, side walls 120, and enclosing plate 130, if present, may be made by any well known attaching or joining technique appropriate to the material selected for manufacture of the trolley, including but not limited to screws, nails, welding, or gluing.

Figure 3:
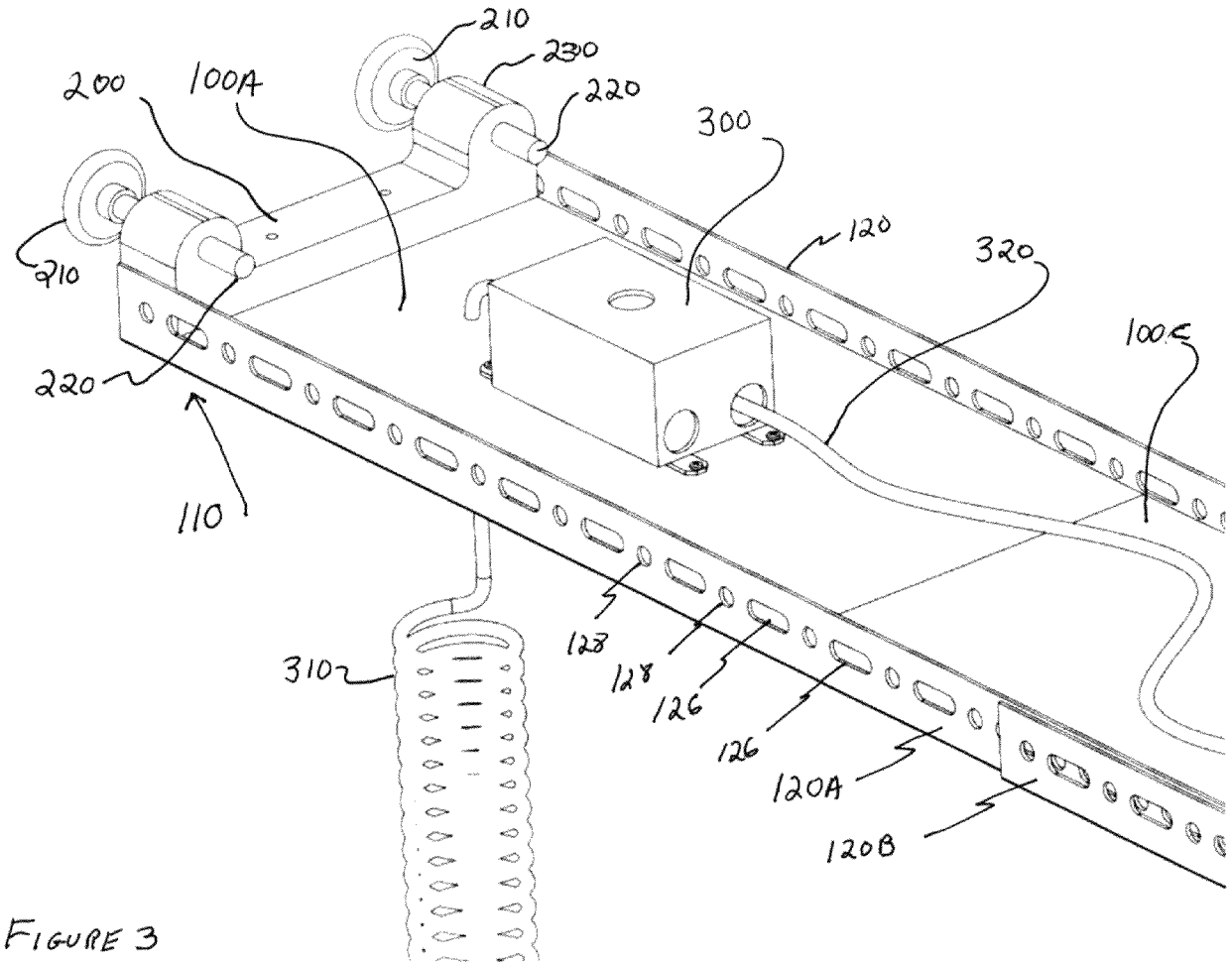
FIG. 3 is a detail illustration of a roller set and supply/distribution box.
Figure 4:
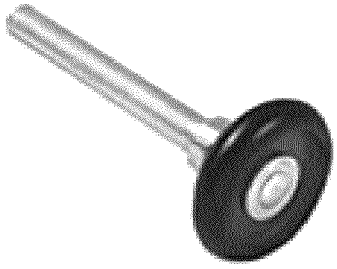
FIG. 4 illustrates a commercially available roller/axle combination.

As shown in FIG. 2, trolley 10 further comprises two or more roller sets 200, wherein a roller 210 is a wheel designed to match a track. Rollers 210 are preferably designed to operate in industry-standard tracks used in the roll-up overhead garage door industry. As shown in FIG. 3, roller set 200 comprise at least one roller 210, said roller attached to an axle 220, the axle attached, directly or indirectly, to a side of trolley 10. Roller/axle combined units, as illustrated for example in FIG. 4, are available as standard parts in the overhead door industry. One or both of the axle attachments is a rotary attachment; that is, at one or more attachment the axle is allowed to rotate, preferably with low friction, relative to the mating part while being constrained in the axial direction. This axial constraint does not need to be absolute; the axial constraint is only required to keep the axle from falling out of the rotary attachment. Generally the rotary attachment is a ball bearing or oil impregnated bushing although a dry sleeve (i.e., a hole) may be used.

In some embodiments, as shown in FIG. 2 and FIG. 3, roller set 200 further comprises a bracket 230. Bracket 230 forms the interface between axle 220 and support platform 100. In other embodiments axle 220 is attached directly to trolley 10, typically to a side wall 120. Several components comprising roller set 200 are available commercially from manufacturers of overhead door components, distributed at retail by many vendors such as Overhead Garage Door Store, PO Box 2814, Oregon City, Oreg. 97045.

In some embodiments, roller set 200 comprises a single roller/axle/bracket whilst in other embodiments, such as illustrated in FIGS. 2 and 3, a roller set 200 comprises two or more rollers 210 each individually mounted on axles 220. The two or more axles may be attached to support platform by a single bracket 230 or they may attached with two individual brackets 230 or they may be attached without a bracket directly to a sidewall 120.

Figure 8:
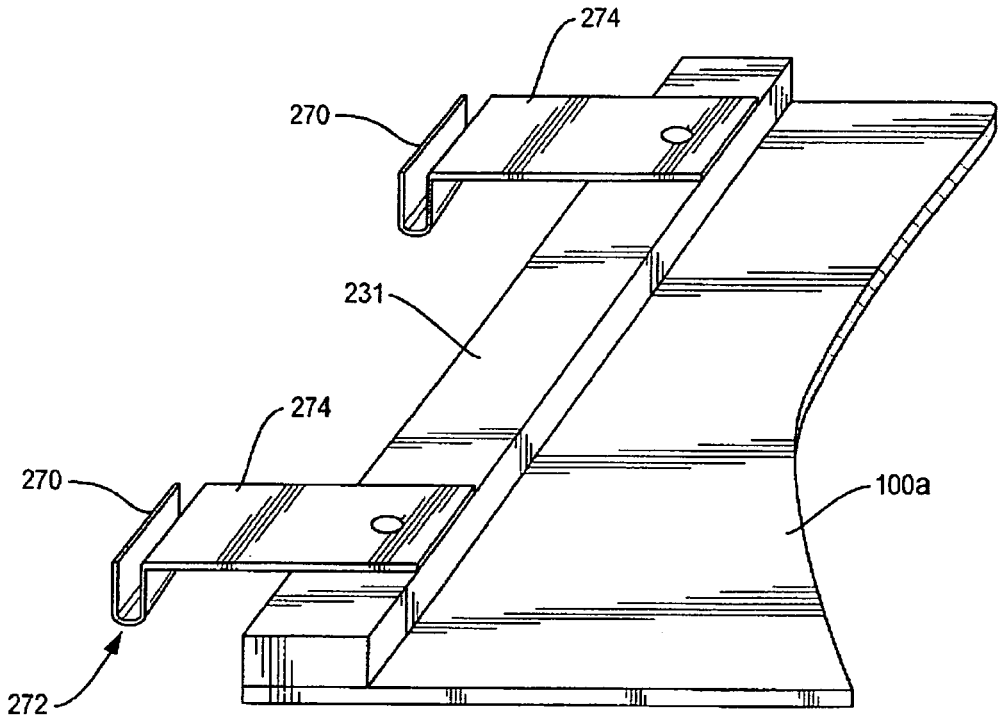
FIG. 8 illustrates the use of skid blocks on an overhead door equipment trolley.

In some embodiments, roller set 200 comprises skid blocks 270 as substitutions for rollers 210. As illustrated in FIG. 8, skid blocks are preferably shaped to match the cross-section of the track on which trolley 10 is intended to ride. In the exemplary embodiment of FIG. 8, skid blocks 270 comprise a U-shaped channel wherein the essentially semi-cylindrical bottom 272 of the "U" has a radius comparable with the external radius of a standard overhead roll-up door roller 210, shown in FIG. 4. In other embodiments skid block 270 may be a solid block with a similar lower edge radius. Preferably the skid blocks are manufactured from a low friction, low wearing material, for example, polished steel, which will allow trolley 10 to move forward and backward in the overhead door track without significant resistance. Skid blocks 270 are attached to the trolley, typically, with a fixed skid block arm 274, such that semi-cylindrical bottoms 272 ride in the existing overhead door track. In some embodiments block arm 274 is attached to the end of support platform 100 with a bracket 231. Skid block arm 274 is preferably rigid in the front-back direction but may have springiness in the up-down direction.

It may be noted that in FIGS. 1, 2 and 3, rollers 210 are disposed to project outwardly from the right 112 and left 110 sides of trolley 10. This orientation is based on the design decision that the illustrated trolley should be positioned between the tracks 920 of roll-up overhead door 910. As will be described below in conjunction with FIG. 5, rollers 210 are sometimes disposed to point inwardly towards the center of trolley 10, such as when the trolley is supported by the adjacent tracks of adjacent overhead doors. Further, hybrid versions of trolley 10 are possible, whereby, for example, the trolley is supported by the left hand tracks of two adjacent overhead doors. In such hybrid versions one set of rollers are disposed to project outwardly while the other set of rollers are disposed to project inwardly.

As illustrated, for example, in FIG. 3, some embodiments of trolley 10 further comprise an electrical supply/distribution junction box 300. Supply/distribution box 300 is disposed at any convenient location in or on trolley 10. Box 300 comprises an electrical input and one or more electrical outputs. Typically, the electrical input comprises a multi-conductor electric supply cord 310 where the cord is compatible with local building and electrical codes and is configured to be compatible with a user's electrical service. For example, most residential units in the United States have 15 ampere or 20 ampere service at 110-120 VAC. Supply cord 310 is configured with a locally compatible plug, for example, in the US, a National Electrical Manufacturers Association (NEMA) standard 5-15P or 5-20P plug.

Supply cord 310 may enter supply/distribution box 300 from any convenient direction (top, side, or bottom) at the designer's discretion. In some embodiments supply cord may be self-coiling, as illustrated, to minimize interference with activities below trolley 10. Self-coiling power cords are readily available; for example, a 20 foot, 3-conductor, coiled cord, part number NCV183, is available from CABLE-science, 9211 Greenleaf Ave., Santa Fe Springs, Calif. 90670.

The output from supply/distribution box 300 may take several forms depending on whether trolley 10 is to be delivered to a user as a fully factory-configured unit or as an end-user configurable unit. In one embodiment, illustrated in the partial bottom view in FIG. 7, the output of supply/distribution box 300 comprises code approved electrical wiring 320A to supply current to an illumination fixture 400. In this exemplary embodiment fixture 400 is substantially a fluorescent "work light" comprising two linear fluorescent tubes 410. In another embodiment the output of supply/distribution box 300 is one or more pairs of electrical "pig-tail" wires 320 to which one or more pieces of electrical equipment may be hard-wired. In another embodiment, not illustrated, the output of box 300 comprises an electrical power strip, into which pieces of electrical equipment may be plugged. In yet other embodiments, box 300 itself is configured with one or more standard electrical receptacles such as NEMA 5-15R receptacles or with an electrical socket for other electrical devices, for example, a light bulb.

Figure 7:
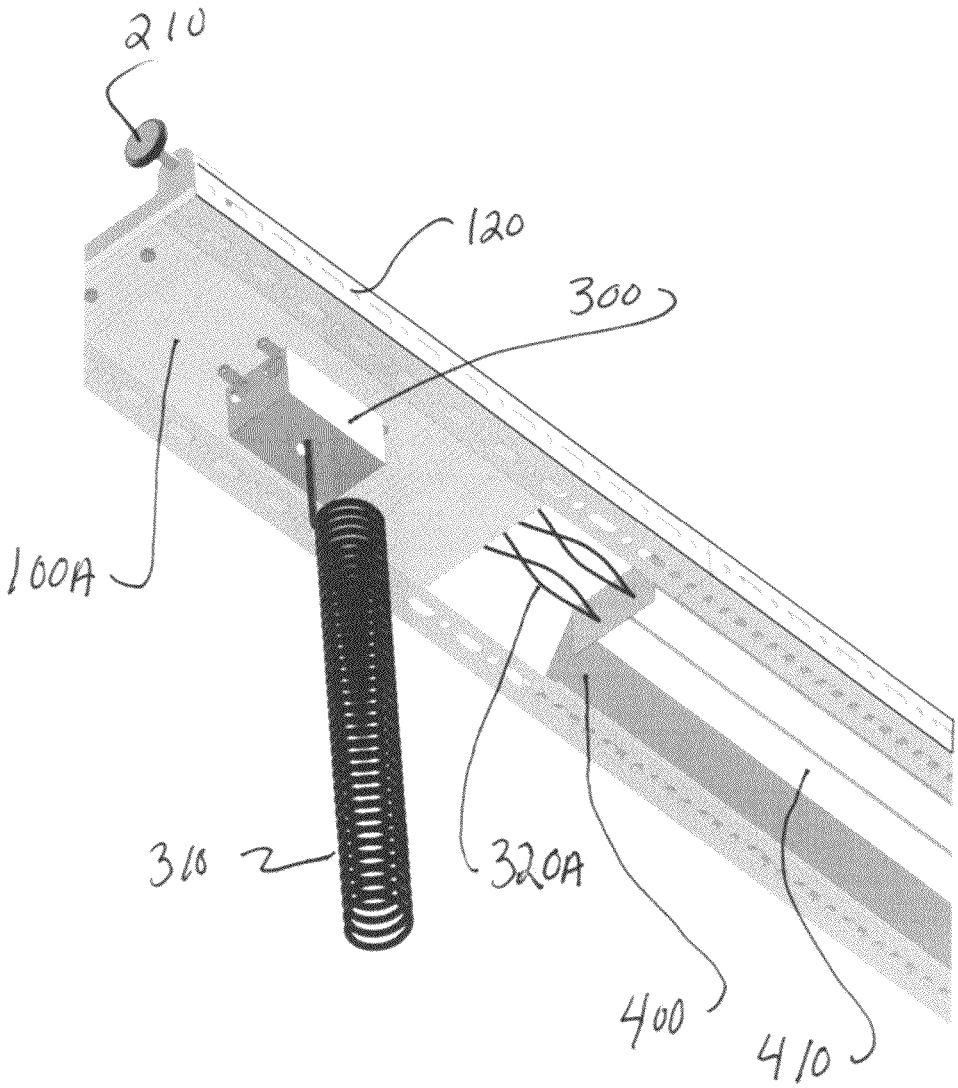
FIG. 7 illustrates an electrical light fixture installed on an overhead door equipment trolley.

Trolley 10 may be embodied to be field adjustable in length to better fit specific overhead door installations. In one embodiment, side rails 120 comprise two or more overlapping segments, for example, segments 120A and 120B as illustrated in FIG. 3. Trolley length is adjusted by increasing or decreasing the overlap between said segments. Side segments used to form an adjustable length trolley, such as segments 120A and 120B are preferably pre-drilled/machined with a series of slots 126 and/or holes 128 wherein nuts, bolts, and washers (not shown) can be used to secure the overlapping segments at the desired length. Support platform 100 may also be adjusted in length by segmentation. In the exemplary embodiments illustrated in FIGS. 2 and 3, support platform 100 comprises three segments 100A, 100B, and 100C. In one embodiment the sum of the lengths of these platform segments is the shortest length obtainable for trolley 10. When the length of the trolley is adjusted to be longer, gaps are allowed to exist between the three segments. In another embodiment the sum of the lengths of the segments is the maximum length obtainable for trolley 10. When the length is adjusted to be shorter, the length of at least one of the segments, preferably the center segment, is reduced, generally by sawing. In yet other embodiments, central segment 100C may be left out altogether, as illustrated in FIG. 7 where central segment 100C has been replaced with fluorescent fixture 400.

Figure 5:
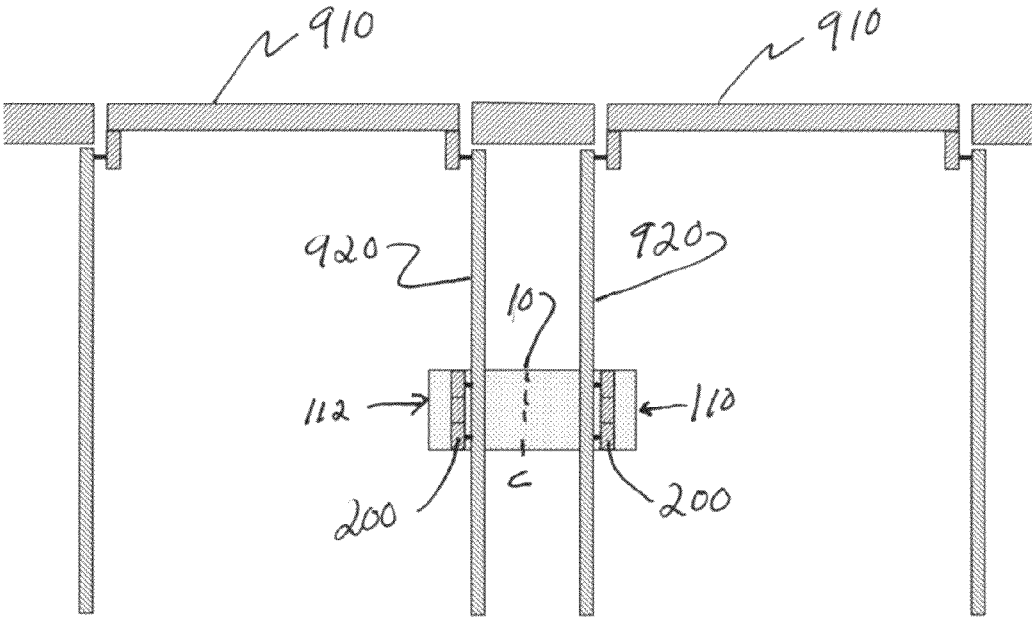
FIG. 5 illustrates schematically a second exemplary installation of a trolley.
Figure 6:
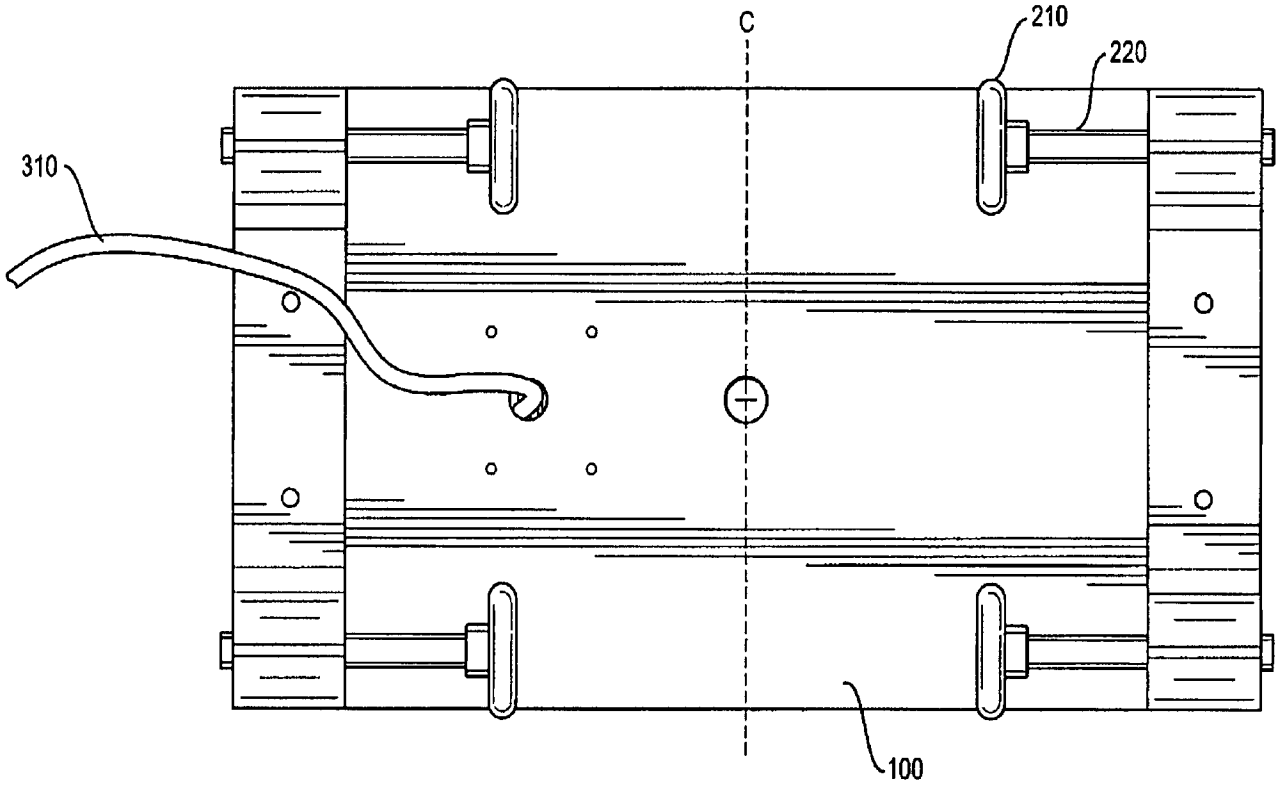
FIG. 6 is an illustration of a second embodiment of an overhead door equipment trolley.

FIG. 5 schematically illustrates a trolley 10 as it would be typically installed in a dual overhead door workspace when it is desirable to share one trolley between the two spaces behind the two access doors. FIG. 6 illustrates one example of this "shared" embodiment, wherein trolley 10 rides on one track from each of the two overhead doors. In this embodiment, roller sets 200 are disposed on opposing sides of, and generally equally spaced from, a central line C of trolley 10, where central line C is parallel to a front-to-back axis and runs through an estimated center of mass. This preferred roller disposition maintains substantially equal weight on each roller set. Note that the roller sets 200 of the embodiment in FIG. 6 are disposed at the outer edges of support platform 100 but other embodiments it may be desirable to extend support platform 100 beyond the limit of one or both tracks, as is suggested in FIG. 5. In an embodiment where support platform 100 has been so extended, it is preferable that support platform be extended substantially symmetrically to maintain central line C between roller sets 200.

As was mentioned above and illustrated in FIG. 6, in trolley embodiments that are disposed to ride on tracks from adjacent overhead doors, rollers 210 are typically disposed to point inwardly towards the center of trolley 10.

In a typical installation, trolley 10 is disposed on the horizontal portions of the left and right tracks of a roll-up overhead access door (or, alternatively, on a pair of tracks from adjacent doors). With the access door in the closed ("down") position, trolley 10 may be moved forward (toward the access door) or backward in the tracks, thereby positioning any equipment mounted thereon, for example, a light fixture, at any desired location within the range of the horizontal track sections. In some embodiments a "leash" of some design may be attached to trolley 10 to make positioning of trolley possible without the need to reach up to the typical six-foot-plus height at which the trolley typically rides. In those embodiments in which trolley 10 comprises an electrical supply/distribution box 300, supply cord 310 will typically be plugged into a wall or ceiling mounted receptacle. Generally supply cord 310 can connected to the receptacle via a route that allows cord 310 to be left plugged in full-time. In some installations the receptacle is wall mounted, in which installation a power switching mechanism can be installed at the receptacle to power and depower the trolley. In other installations, such as those with a ceiling mounted receptacle, it may be desirable to mount a switch on the bottom of trolley 10 to turn power on and off.

When the roll-up overhead is opened to allow access to the workspace, the upper edge of the door contacts the front edge of trolley 10 and pushes trolley 10 backward along the tracks without damage to either door or trolley. In some instances it may be desirable to added a compliant bumper material along the front edge of trolley 10.

While various embodiments of the innovation have been particularly shown and described, it will be understood by those skilled in the art that various changes in form and details may be made therein without departing from the spirit and scope of the innovation as defined by the appended claims. For example, virtually any object or piece of equipment may be attached or integrated onto support platform 100, whether or not said object or piece of equipment is electrically powered.

The invention claimed is:

1. An electro-mechanical utility trolley comprising:

a trolley body, said body comprising a support platform, said platform extending lengthwise between a left edge and a right edge, opposite said left edge, and defining a width of said trolley body, said right and left edges of said platform defining a depth of said trolley body, said width of trolley body being greater than said depth of said trolley body;

a first roller set, said first roller set disposed at left edge of said platform, said first roller set comprising at least one roller, said roller attached to an axle, said axle attached to the trolley body;

a second roller set, said second roller set disposed at right edge of said platform, said second roller set comprising at least one roller, said roller attached to an axle, said axle attached to the trolley body;

wherein said rollers are compatible with an existing overhead door roller track.

2. The trolley of claim 1 wherein the first roller set comprises a second roller, said second roller attached to an axle, said axle attached to the trolley body, wherein further said first and said second roller are separated along a front-to-back axis.

3. The trolley of claim 1 wherein the second roller set comprises a second roller, said second roller attached to an axle, said axle attached to the trolley body, wherein further said first and said second roller are separated along a front-to-back axis.

4. The trolley of claim 1 further comprising an electrical cord.

5. The trolley of claim 1 further comprising one or more side walls, said side walls disposed perpendicular to the support platform, said side walls further disposed at the periphery of said support platform.

6. The trolley of claim 5 further comprising an enclosing plate, said enclosing plate disposed perpendicular to the side walls.

7. The trolley of claim 1 further comprising a movement control leash, the leash disposed at or near the front of the trolley.

8. The trolley of claim 1 further comprising an electrical distribution box disposed on the trolley body; and electrical pig-tail wires electrically coupled to the electrical distribution box and extending from the electrical distribution box.

9. The trolley of claim 8 wherein the electrical pig-tail wires are electrically coupled to at least one of an illumination fixture, electrical power strip, and electrical receptacle.

10. The trolley of claim 1 further comprising a front edge and a back edge each extending lengthwise between said left and right ends of said platform; each of said front edge and said back edge includes at least two overlapping sections such that said width of said trolley body can be adjusted.

11. The trolley of claim 1 further comprising a centerline defined by a midpoint between front and back edges; and wherein said first roller set and said second roller set each face towards said centerline.

12. The trolley of claim 1 further comprising a centerline defined by a midpoint between front and back edges; and wherein said first roller set and said second roller set each face away said centerline.

13. An electro-mechanical utility trolley comprising:

a trolley body, said body comprising a support platform, said platform extending lengthwise between a left edge and a right edge, opposite said left edge, and defining a width of said trolley body, said right and left edges of said platform defining a depth of said trolley body, said width of trolley body being greater than said depth of said trolley body;

a first skid block set disposed at left edge of said platform, said first skid block set comprising at least one skid block;

a second skid block set disposed at right edge of said platform, said second skid block set comprising at least one skid block;

wherein each skid block includes a semi-cylindrical portion and is compatible with an existing overhead door roller track.

* * * * *